United States Patent [19]

Deutsch

[11] Patent Number: 4,643,067

[45] Date of Patent: Feb. 17, 1987

[54] SIGNAL CONVOLUTION PRODUCTION OF TIME VARIANT HARMONICS IN AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 631,131

[22] Filed: Jul. 16, 1984

[51] Int. Cl.[4] ..... G10H 1/00

[52] U.S. Cl. ..... 84/1.01; 84/1.03

[58] Field of Search ..... 84/1.01, 1.03

[56] References Cited

U.S. PATENT DOCUMENTS

| | | | |
|---|---|---|---|
| 4,085,644 | 4/1978 | Deutsch et al. | 84/1.01 |
| 4,127,047 | 11/1978 | Tomisawa | 84/1.01 |
| 4,244,257 | 1/1981 | Niimi et al. | 84/1.01 |
| 4,409,876 | 10/1983 | Katoh . | |

*Primary Examiner*—William M. Shoop, Jr.
*Assistant Examiner*—Sharon D. Logan
*Attorney, Agent, or Firm*—Ralph Deutsch

[57] ABSTRACT

A keyboard operated electronic musical instrument is disclosed which has a number of tone generators each of which is assigned to an actuated keyswitch. The generated musical waveshapes are transformed to produce tones having a time variant spectra by processing the waveshapes with a time variant masking function.

11 Claims, 9 Drawing Figures

SIGNAL CONVOLUTION PRODUCTION OF TIME VARIANT HARMONICS IN AN ELECTRONIC MUSICAL INSTRUMENT

BACKGROUND OF THE INVENTION

1. Field of the Invention

This invention relates to electronic musical tone synthesis and in particular is concerned with producing tones with time variant harmonic strength by convoluting two signal spectra.

2. Description of the Prior Art

An elusive goal in the design of keyboard electronic musical instruments is to attain the ability to realistically imitate the easily recognizable sounds of conventional acoustic type musical instruments. It has long been recognized that, with the notable exception of conventional organ tones, almost all tones produced by acoustic musical instruments exhibit tone spectra which are time variant in composition. A simple tone having a waveshape that is repeated cyclically and endlessly quite rapidly fatigues a listener.

The most commonly used tone generation system employed to produce time variant harmonic tone structure is the generic system called a "synthesizer." A synthesizer system contains a sliding formant filter as its essential constituent. The sliding formant filter is generally implemented as a frequency domain filter of either the low pass or high pass type and is configured so that it has the capability of varying the filter cut-off frequency in response to an electrical control signal.

Analog tone synthesizers usually employ a voltage controlled frequency filter to provide a sliding formant frequency response. Such a filter can vary the analog musical waveshape spectral response under the action of a control signal. Digital tone generators can produce corresponding spectral variations, similiar to those obtained in analog systems, by employing digital filters to vary the spectral content of a digital sequence of waveshape points which are later converted into analog signals to furnish a musical waveshape. A digital filter implementation for use as a formant filter subsystem is described in U.S. Pat. No. 4,267,761 entitled "Musical Tone Generator Utilizing Digital Sliding Formant Filter."

Synthesizers employing sliding formant filters are given the generic designation of subtractive synthesis tone generators. This terminology is appropriate because a sliding formant filter acts only to reduce the strength of frequency components which are already present at the input terminals of the filter. No new harmonic components are produced if the formant filters are linear system elements.

An alternative to the use of sliding filter formants to produce time variant harmonics in a musical tone is to employ a time variant nonlinear transformation of a musical waveshape. An example of such a waveshape distortion system is disclosed in U.S. Pat. No. 4,300,432 entitled "Polyphonic Tone Synthesizer With Loudness Spectral Variation." A combination of waveshape distortion and a sliding formant filter is disclosed in U.S. Pat. No. 4,300,434 entitled "Apparatus For Tone Generation With Combined Loudness And Formant Spectral Variation."

A common technique for distorting a musical waveshape is to use some form of signal modulation. Musical instruments have been designed which employ frequency modulation subystems to produce time variant distortions of a simple sinusoid signal at the musical tone's fundamental frequency. Such a system is disclosed in U.S. Pat. No. 4,175,464 entitled "Musical Tone Generator With Time Variant Overtones." Experimentally it has been found thatthe most useful musical effects are obtained when the modulation frequency is close to or equal to the carrier frequency.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted into musical waveshapes. A sequence of computation cycles is implemented during each of which a master data set is generated. The master data set comprises a set of data points which define a period of a musical waveshape.

The master data set is computed using a set of stored harmonic coefficients. After the master data set is computed, a transfer cycle is initiated during which the master data set is transferred to a plurality of note registers. There is a note register associated with each tone generator. The data stored in a note register is read out sequentially and repetitively by a note clock such that the memory address advance rate corresponds to a fixed multiple of the fundamental musical frequency associated with an actuated keyboard switch.

The spectrum of the signal read out from a note register is altered in a time variant fashion by multiplying this data by a time variant mask function. The output signal has a time variant spectrum.

An embodiment of the invention is presented for an analog musical tone generator.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a polyphonic musical tone generation system wherein waveshapes are modified in tone color as a function of time by convoluting the spectra of two signals. The tone modification system is incorporated into a musical instrument of the type which synthesizes musical waveshapes by implementing a discrete Fourier transform algorithm. A tone generation system of this category is described in detail in U.S. Pat. No. 4,085,644 entitled "Polyphonic Tone Synthesizer." This patent is hereby incorporated by reference. In the following description all elements of the system which are described in the referenced patent are identified by two digit numbers which correspond to the same numbered elements appearing in the referenced patent.

Figure 1:
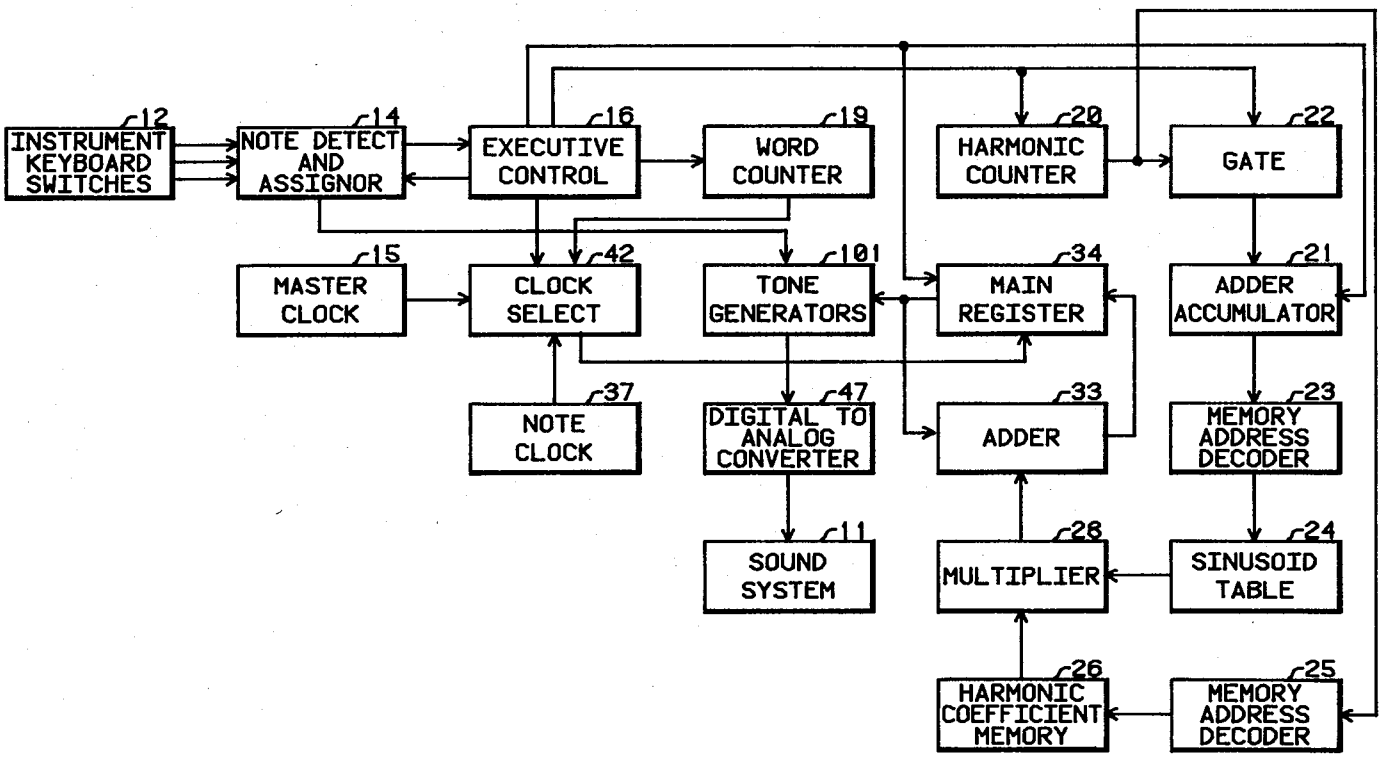
FIG. 1 is a schematic diagram of an embodiment of the invention.

FIG. 1 shows an embodiment of the present invention which is described as a modification and adjunct to the system described in U.S. Pat. No. 4,085,644. As described in the referenced patent, the Polyphonic Tone Synthesizer includes an array of instrument keyboard switches 12. If one or more of the keyboard switches has a switch status change and is actuated ("on" switch position), the note detect and assignor 14 encodes the detected keyboard switch having the status change to an actuated state and stores the corresponding note information for the actuated keyswitches. A tone generator, contained in the block labeled tone generators 101, is assigned to each actuated keyswitch using information generated by the note detect and assignor 14.

A suitable configuration for a note detect and assignor subsystem is described in U.S. Pat. No. 4,022,098. This patent is hereby incorporated by reference.

When one or more keyswitches have been actuated, the executive control 16 initiates a repetitive sequence of computation cycles. During each computation cycle, a master data set is computed. The 64 data words in a master data set correspond to the amplitudes of 64 equally spaced points of one cycle of the audio waveform for a musical tone. The general rule is that the maximum number of harmonics in the audio tone spectra is no more than one-half of the number of data points in one complete waveshape period. Therefore, a master data set comprising 64 data words corresponds to a musical waveshape having a maximum of 32 harmonics.

As described in the referenced U.S Pat. No. 4,085,644, it is desirable to be able to continuously recompute and store the master data set during a repetitive sequence of computation cycles and to load this data into note registers while the actuated keyswitches remain actuated, or depressed, on the keyboards. There is a note register associated with each tone generator contained in the system block labeled tone generators 101.

In the manner described in the referenced U.S. Pat. No. 4,085,644 the harmonic counter 20 is initialized to its minimal, or zero, count state at the start of each computation cycle. Each time that the word counter 19 is incremented by the executive control 16 so that it returns to its minimal, or zero, count state because of its modulo counting implementation, a signal is generated by the executive control 16 which increments the count state of the harmonic counter 20. The word counter 19 is implemented to count modulo 64 which is the number of data words comprising the master data set. The harmonic counter 20 is implemented to count modulo 32. This number corresponds to the maximum number of harmonics consistent with a master data set comprising 64 data words.

At the start of each computation cycle, the accumulator in the adder-accumulator 21 is initialized to a zero value by the executive control 16. Each time that the word counter is incremented, the adder-accumulator 21 adds the current count state of the harmonic counter 20 to the sum contained in the accumulator. This addition is implemented to be modulo 64.

The content of the accumulator in the adder-accumulator 21 is used by the memory address decoder 23 to access trigonometric sinusoid values from the sinusoid table 24. The sinusoid table 24 is advantageously implemented as a read only memory storing values of the trigonometric function $\sin(2\pi\phi/64)$ for $0 \leqq \phi \leqq 64$ at intervals of D. D is a table resolution constant.

The memory address decoder 25 reads out harmonic coefficients stored in the harmonic coefficient memory 26 in response to the count state of the harmonic counter 20. The multiplier 28 generates the product value of the trigonometric value read out from the sinusoid table 24 and the value of the harmonic coefficient read out from the harmonic coefficient memory 26. The generated product value formed by the multiplier 28 is furnished as one input to the adder 33.

The contents of the main register 34 are initialized to a zero value at the start of each computation cycle. Each time that the word counter 19 is incremented, the content of the main register 34, at an address corresponding to the count state of the word counter 19, is read out and furnished as an input to the adder 33. The sum of the inputs to the adder 33 are stored in the main register 34 at a memory location equal, or corresponding, to the count state of the word counter 19. After the word counter !9 has been cycled for 32 complete cycles of 64 counts, the main register 34 will contain the master data set which comprises a complete period of a musical waveshape having a spectral function determined by the set of harmonic coefficients provided to the multiplier 28.

Following each computation cycle, in the repetitive sequence of computation cycles, a transfer cycle is initiated and executed. During a transfer cycle the master data set stored in the main register 34 is copied out and stored in a set of note registers. There is a note register associated with each of the tone generators contained in the system block labeled tone generators 101.

The master data set stored in each of the note registers is read out sequentially and repetitively in response to timing signals provided by a note clock which is associated with each of the tone generators contained in the system block labeled tone generators 101.

The data read out of the note register is transformed in a manner described below and the transformed data is converted into an analog signal by means of the digital-to-analog converter 47. The resultant analog signal is transformed into an audible musical sound by means of the sound system 11. The sound system 11 contains a conventional amplifier and speaker combination for producing audible tones.

Figure 2:
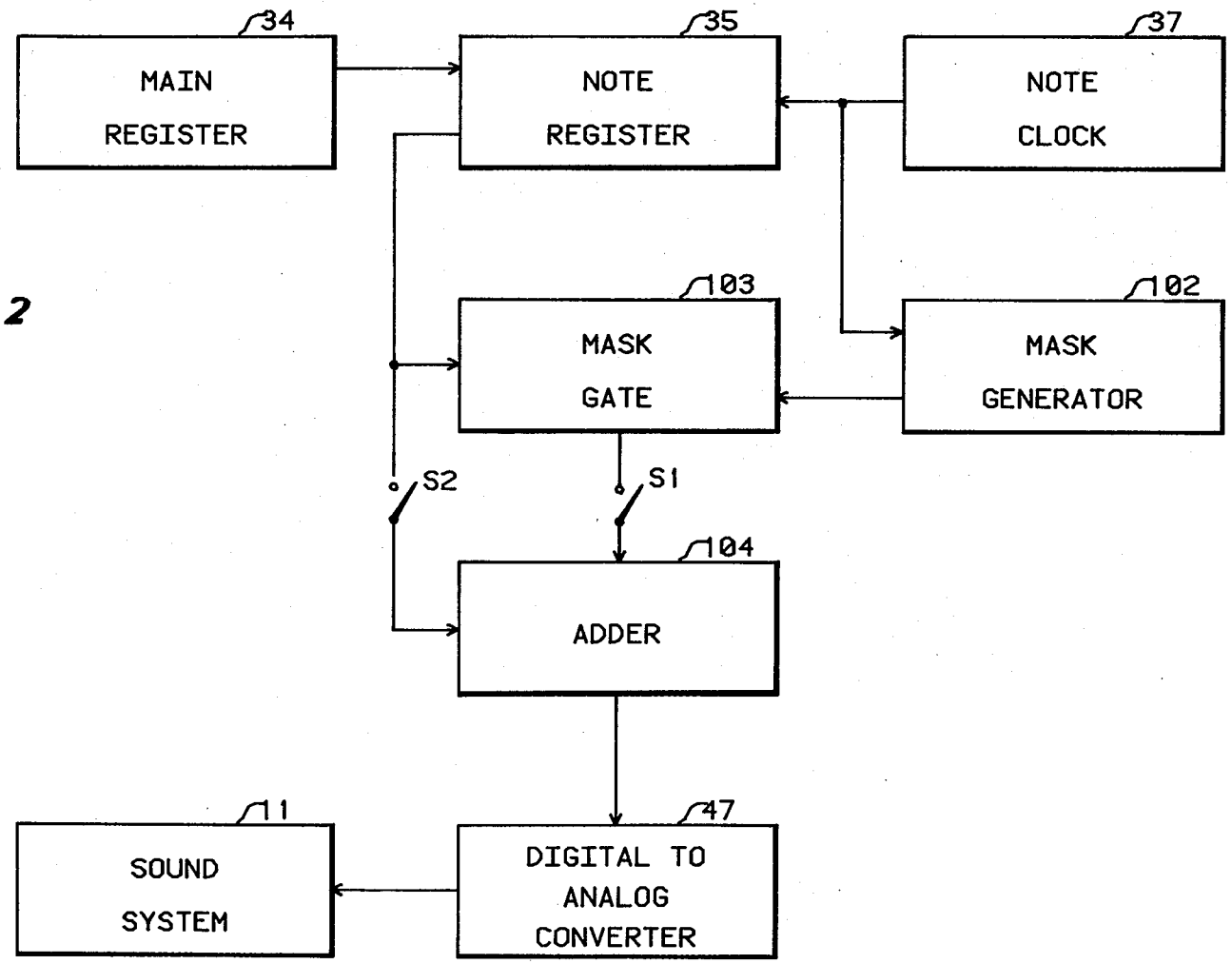
FIG. 2 is a schematic diagram of the signal convolutor.

The transformation of the master data set read out of a note register is accomplished by means of a signal convolutor which is shown in FIG. 2. FIG. 2 explicitly shows logic blocks for a single tone generator. It is understood that similar logic is associated with each of the tone generators contained in the system logic block labeled tone generators 101.

If the tone switch S2 is closed, then the data words read out of the note register 35 in response to timing signals are provided as an input to the adder 104. The output from the adder 104 is provided to the digital-to-analog converter to be converted into an analog musical waveshape.

In a manner described below, the mask generator 102 generates a time variant mask function in response to the time signals provided by the note clock 37. The mask gate 103 multiplies the master data set data points read out of the note register 35 by the time variant mask function furnished by the mask generated. The net result is called a convoluted signal. If switch S1 is closed, then the convoluted signal is provided as one of the input data sources to the adder 104. The function of the adder 104 is to provide selected combinations of the master data set data and the convoluted signal to be converted into audible tones by means of the combination of the digital-to-analog converter 47 and the sound system 11.

Figure 3:
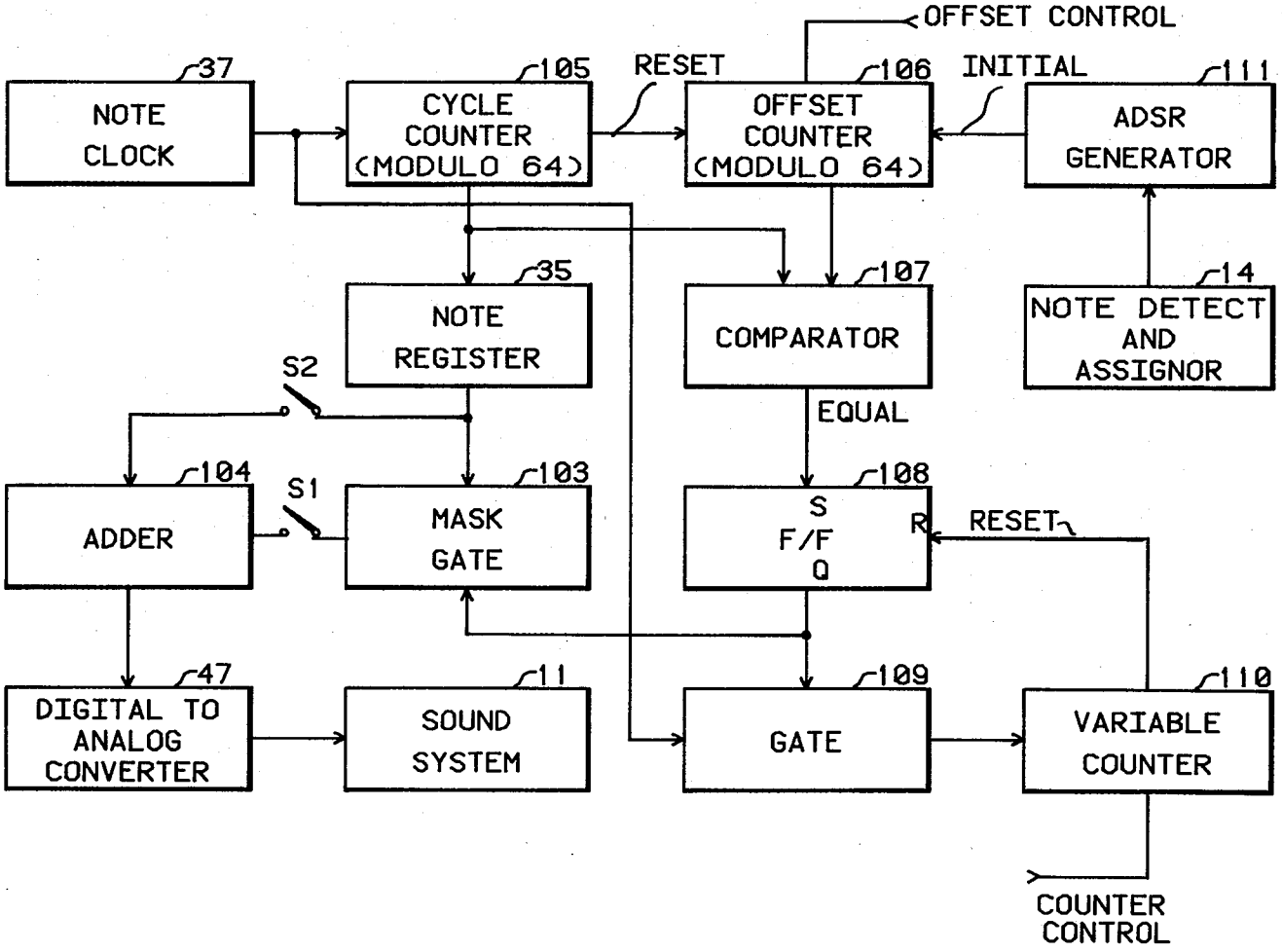
FIG. 3 is a schematic diagram of the mask generator 102.

FIG. 3 illustrates an embodiment of the mask generator 102. The cycle counter 105 is incremented by the timing signals provided by the note clock 37. The cycle counter 105 is implemented to count modulo 64 which is the number of data words comprising the master data which is stored in the note register 35. The count state of the cycle counter 105 is used as a memory address to read out master data set data words stored in the note register 35.

A RESET signal is generated by the cycle counter 105 each time that it is incremented so that it returns to its minimal count state because of its modulo counting implementation. The offset counter 106 is incremented by the RESET signal. The offset counter 106 is implemented to count modulo 64. The offset counter 106 is reset to its minimal count state in response to an INITIAL signal provided by the ADSR generator 111 (attack/decay/sustain/release). Using new signal detection data provided by the note detect and assignor 14, the ADSR generator 111 creates the INITIAL signal when it starts its attack phase of the ADSR envelope function generator for a tone generator that has been assigned to an actuated keyboard switch.

A suitable implementation for the ADSR generator 111 is described in U.S. Pat. No. 4,079,650 entitled "ADSR Envelope Generator." This patent is hereby incorporated by reference.

The comparator 107 compares the count state of the offset counter 106 with the count state of the cycle counter 105. An EQUAL signal is generated by the comparator 107 when the two counters have identical count states. In this fashion the time at which the EQUAL signal is generated changes in a cyclic fashion with respect to the time in which the cycle counter 105 is at its minimal count state.

The flip-flop F/F 108 is set in response to the EQUAL signal generated by the comparator 107. When F/F 108 is set, its output Q is a binary logic state Q="1".

When Q="1", the gate 109 transfers the timing signals provided by the note clock 37 to increment the variable counter 110. When the variable counter reaches its maximum count state it generates a RESET signal and then returns to its minimal count state when the next timing signal is received. In response to this RESET signal from the variable counter 110, the F/F 108 is reset thereby causing the gate 109 to inhibit the timing signals from the note clock 37 from reaching the variable counter 110. The maximum count state of the variable counter 110 is selectable by means of a counter control signal.

The output state Q of the flip-flop F/F 108 is the time variant mask function which is provided as an input signal to the mask gate 103. The mask generator 102 comprises the system blocks 105, 106, 107, 108, 109 and 110.

The time variant mask function produced by the means shown in FIG. 3 produces a repetitive pulse-like signal which is cyclically created. The width of the signal can be varied by changing the maximum count of the variable counter 110. The frequency of the time variant mask function is determined by the maximum count state of the offset counter 106. This maximum count can be varied by means of an OFFSET CONTROL signal.

The mask gate 103, which is normally implemented as a multiplier, can be implemented as a simple data gate for the type of pulse-like time variant mask function generated by the means shown in FIG. 3.

The transformation system utilizes the well-known characteristic of signals in that if two time domain signal functions are multiplied together then the product signal will have a spectrum which is the mathematical convolution of the two input signals. Thus if the signal x(t) is multiplied by the signal y(t), the product z(t) in the time domain $$z(y)=x(t)\cdot y(t) \qquad \text{Eq. 1}$$

will have the frequency domain function $$Z(f)=X(f)*Y(f) \qquad \text{Eq. 2}$$

where X(f) is the Fourier transform of x(t), Y(f) is the Fourier transform of y(t) and the asterisk denotes a mathematical convolution product.

Figure 4:
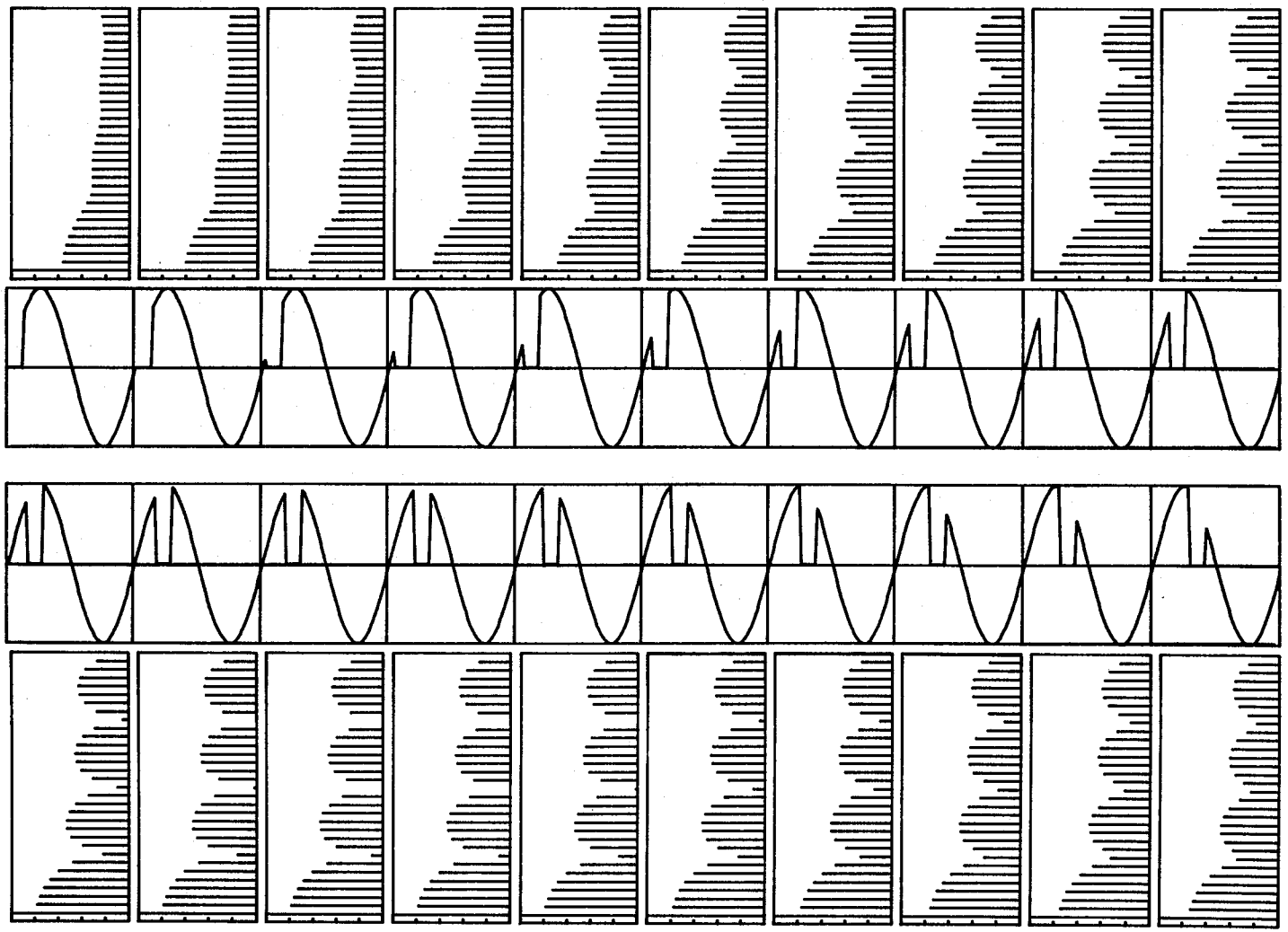
FIG. 4 is a spectrum and waveshape plot of a system simulation calculation.

FIG. 4 illustrates the result of a computer simulation of the time variant mask function transformation produced by the means shown in FIG. 3. The selected master data, which is stored in the note register 35 after a transfer cycle, consists of 64 equally spaced points for a simple sinusoid signal. Each spectrum in the top row of spectra in FIG. 3 corresponds to the waveshape drawn immediately below it. Each spectrum in the bottom row of spectra corresponds to the waveshape drawn immediately above it. The tic marks for the spectra correspond to an interval of −10 db measured from a maximum of 0 db.

The time variant mask function was selected to have a width equal to eight timing pulses for the signal generated by the note clock 37. The 20 waveshape curves represent the first 20 time sequences out of a period of 64 for the time variant mask function It is evident that a time variant signal spectra is produced by the signal transformation subsystem shown in FIG. 2.

Figure 5:
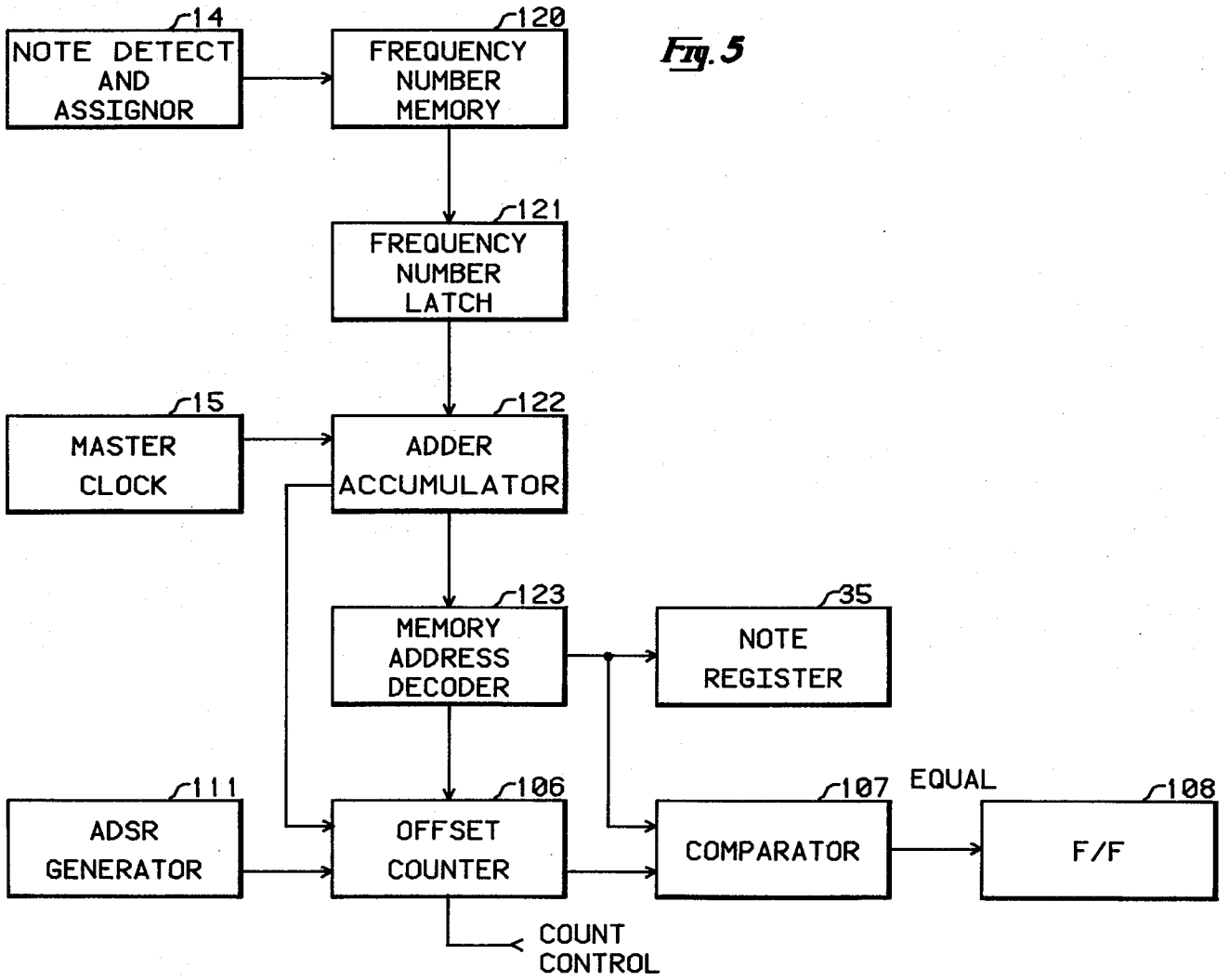
FIG. 5 is a schematic diagram of an alternate implementation of the invention.

FIG. 5 illustrates an alternative implementation for the subsystem shown in FIG. 3. In this alternative implementation the note clock 37 is replaced by a frequency number system in which a selected frequency number is repetitively added to a sum contained in an accumulator. The most significant bits of the content of the accumulator are used to advance the memory address for data read out of the note register 35.

When the note detect and assignor 14 detects that a keyboard switch has been actuated, a corresponding frequency number is read out from the frequency number memory 120. The frequency number memory 120 can be implemented as a read-only addressable memory (ROM) containing data words stored in binary numeric format having values $2^{-(M-N)/12}$ where N has the range of values N+1,2, . . . , M and M is equal to the number of keyswitches on the musical instruments keyboard. The frequency numbers represent the ratios of frequencies of a generated musical tone with respect to the frequency of the master clock 15. A detailed description of the frequency numbers is contained in U.S. Pat. No. 4,114,496 entitled "Note Frequency Generator For A Polyphonic Tone Synthesizer." This patent is hereby incorporated by reference.

The frequency number read out of the frequency number memory 120 is stored in a frequency number latch 121. In response to timing signals provided by the master clock 15, the frequency number stored in the frequency number latch 121 is added to the contents of an accumulator contained in the adder-accumulator 122. The six most significant bits of the accumulated sum contained in the accumulator is used by the memory address decoder 123 to read out master data set points from the note register 35.

Each time that the six most significant bits of the content of the accumulator in the adder-accumulator 122 all have a "0" value, a signal is generated which is used to increment the count state of the offset counter 106. This condition establishes a phase reference. The comparator 107 compares the count W state of the counter 106 with the address generated by the memory address decoder 123. An EQUAL signal is generated when the two compared values have identical values.

An additional system parameter which can be exploited to obtain a wide variety of time variant spectra is to implement the offset counter 106 so that it is not restricted to only count modulo 64 which is the number of data points comprising the master data set. The modulo value, or maximum count, of the counter can be preselected by means of a COUNT CONTROL signal. Alternatively the modulo value can be made to vary with time using a time variant function such as that provided by the ADSR generator 111. The ADSR generator 111 can also be used to initialize the offset counter 106 at the time at which a tone generator is assigned to a newly actuated keyswitch on the musical instrument's keyboard.

Figure 6:
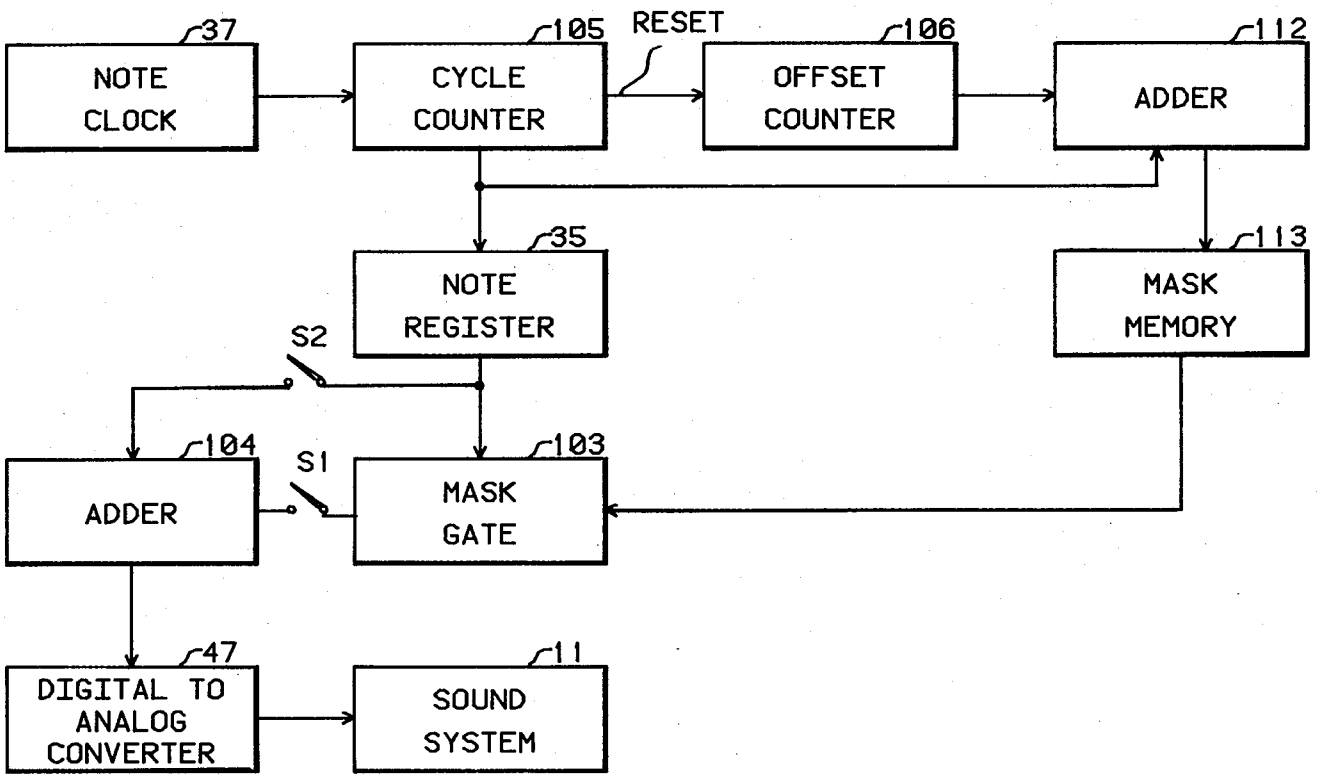
FIG 6 is a schematic diagram of a second alternate implementation of the invention.

FIG. 6 illustrates an alternative implementation for using a time variant mask function. In this implementation the mask function is stored in the mask memory 113. The adder 112 adds the count state of the offset counter 106 with the memory address created by the count state of the cycle counter 105. The summed data produced by the adder 112 is used as a memory address to read out a value of the mask function which is stored in the mask memory 113. The adder 112 is implemented to add modulo 64 which is the number of data words comprising the mask function stored in the mask memory 113. The net result is that the mask function data set is read out of the mask memory 113 sequentially and repetitively at a memory advance rate which is the same as that used to read out the master data set points that are stored in the note register 35. However, the mask function is delayed with respect to an initial phase of the master data set points in a time increasing manner because of the offset address created by the advancing count state of the offset counter 106.

The inventive concept is not limited or restricted to the use of mask functions having only a "0" or "1" binary state value for each data point. It is an obvious extension to store other more general mask functions in the mask memory 113 such that any data value can be selected for each point. For these more general mask functions, the mask gate 103 is implemented as a conventional binary data multiplier.

Figure 7:
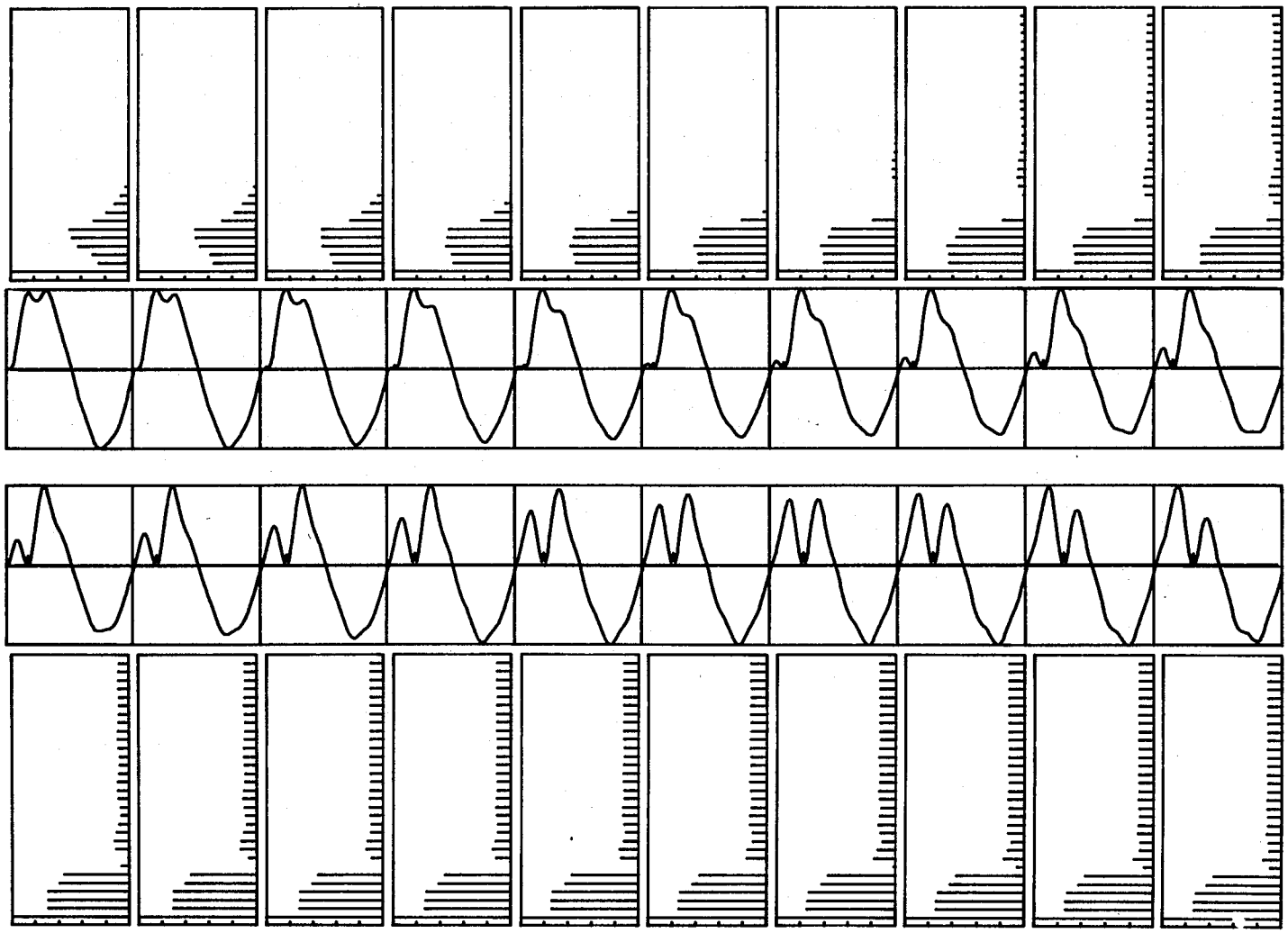
FIG. 7 is a spectrum and waveshape plot of a sin x/x mask function system simulation.

FIG. 7 illustrates the result of a computer simulation calculation for a time variant mask function having the form of $(1-\sin x/x)$. This function is stored in the mask memory 113 of FIG. 6. The master data set stored in the note register 35 consists of 64 equally spaced points for a single sinusoid signal. The sin x/x function was selected for illustrative purposes because its tapered weighting form does not create as many new harmonics by the time variant convolution transform process as are produced by the steep sides of a pulse-like rectangular function. The $(1-\sin x/x)$ was stored in the mask memory 113 with its first maximum value stored in the first memory address position. The relation between waveform and spectra in FIG. 7 are the same as those in FIG. 4 which have been previously defined.

The present invention is not limited or restricted to use with a digital tone generation system. It can be applied to any analog or digital tone generation system in which the individual tone generators are isolated from each other and in which there is a means for determining some specified waveshape point, or phase reference, to be used as a start reference point.

Figure 8:
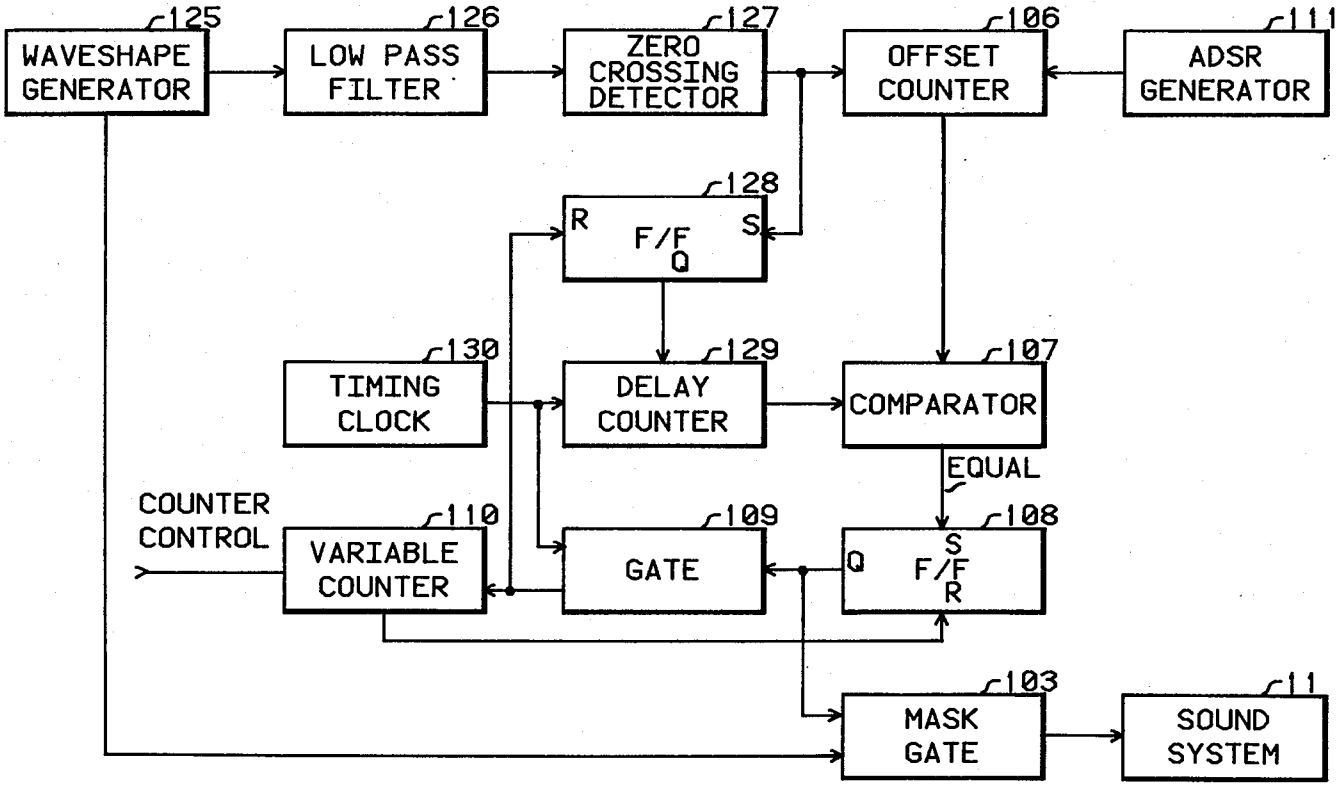
FIG. 8 is a schematic diagram of an embodiment of the invention for an analog signal tone generator.

FIG. 8 illustrates an embodiment of the present invention implemented as a subsystem for an analog musical tone generator. The input analog musical waveshape signal is created by the waveshape generator 125. The low pass filter 126 is used to attenuate the higher harmonics so that the output signal is essentially a simple sinusoid. The zero crossing detector 127 creates a pulse-like phase signal when the input waveshape has a zero crossing of a positive slope. It could also be implemented so that the pulse-like phase signal is created when the input waveshape has a zero crossing of a negative slope. The combination of the low pass filter 126 and the zero crossing detector 127 function as a phase detection means.

The zero detect signals created by the zero crossing detector 127 are used to increment the offset counter 106 and to set the flip-flop F/F 108.

When flip-flop F/F 108 is set, the gate 109 transfers timing signals generated by the timing clock 130 to increment the count state of the variable counter 110. When the variable counter 110 is incremented to its maximum count state, a signal is generated which resets the flip-flop F/F 108. The output state Q of the flip-flop 108 is used as the time variant mask function by the mask gate 103.

The mask gate 103 multiplies the waveshape created by the waveshape generator 125 by the time variant mask function and the product signal is furnished to the sound system 11.

Figure 9:
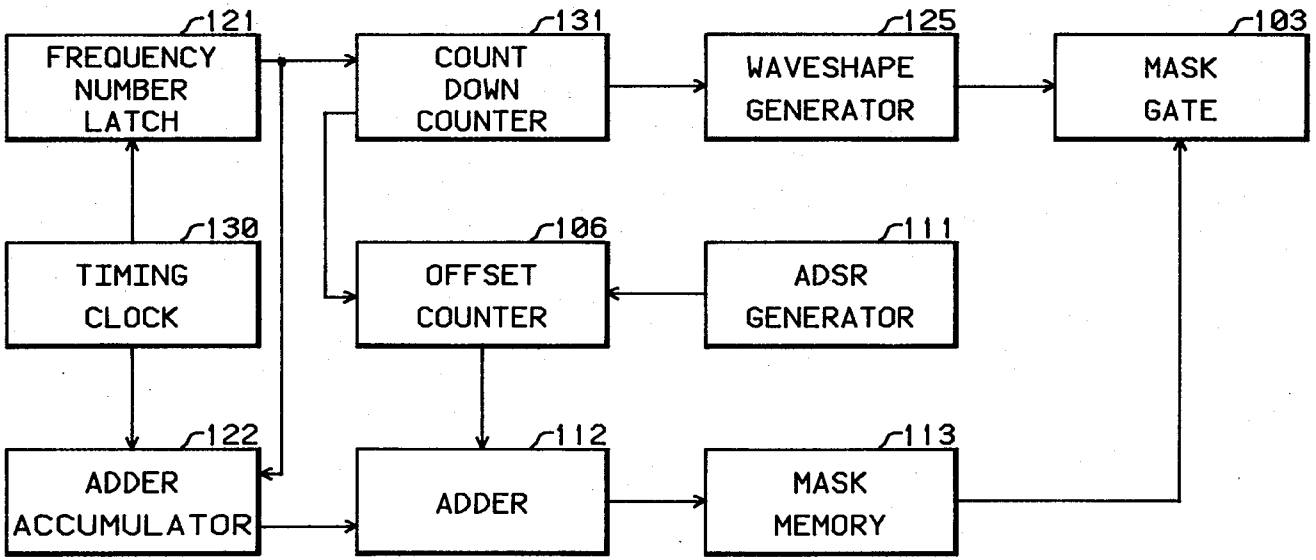
FIG. 9 is a schematic diagram of an alternate embodiment of the invention for an analog signal tone generator.

A second alternative implementation of the present invention for an analog signal musical waveshape generator is shown in FIG. 9. The basic analog signal generator for this system is of the generic type in which a square wave of a selected frequency is generated by repetitively decrementing a counter in response to an assigned frequency number.

The count down counter 131 is decremented by the frequency number stored in the frequency number latch in response to the timing signals created by the timing clock 130. The frequency number stored in the frequency number latch 121 is accessed from a frequency number memory in response to the detection of an actuated keyswitch. The output from the count down counter 131 is used by the waveshape generator 125 in the normal fashion by employing waveshape filters.

Each time that the count down counter 131 is reset to its maximum count state because of its modulo counting implementation, a signal is generated which is used to increment the count state of the offset counter 106. The offset counter 106 is reset to its minimal count state by a signal provided by the ADSR generator 111 when a newly actuated keyswitch is detected.

The frequency number stored in the frequency number latch 121 is repetitively added to the contents of an accumulator contained in the adder-accumulator 122. The sum contained in this accumulator are summed with the count state of the offset counter 106 by means of the adder 112. The output sum from the adder 112 is used as a memory address to read out a data value from the mask memory 113.

The output binary digital value from a data value stored in the mask memory 113 is internally converted to an analog signal which is transmitted to the mask gate 103. In this embodiment the mask gate 103 is implemented as a voltage controlled amplifier which acts to multiply the waveshape output of the waveshape generator 125 by the analog value of the time variant mask function.

I claim:

1. In combination with a musical instrument in which a plurality of data words corresponding to the amplitudes of points defining the wafeform of a musical tone are computed from a preselected set of harmonic coefficients and are transferred sequentially to a means for conversion into musical waveshapes, apparatus for producing musical tones having a time variant spectra comprising;

a waveshape memory means for storing a plurality of data words, a means for computing responsive to said preselected harmonic coefficients whereby said plurality of data words corresponding to the amplitude of points defining the waveform of a musical tone are computed and stored in said first waveshape memory means, a memory addressing means for reading out data words stored in said waveshape memory means, a mask data generator means whereby a mask data word is generated wherein said mask data word is in a binary digital format having a number of bits equal in number to said plurality of data words stored in said waveshape memory means, a bit selection means responsive to said memory addressing means whereby consecutive bits are selected from said mask data word in a cyclic and periodic order wherein the starting bit position is changed in a time variant manner, a mask gate responsive to said selected bits from said mask data word whereby a data word read out from said waveshape memory means is transferred unaltered if the selected bit has a logic value of "1" and whereby a zero value data word is transferred if said selected bit has a logic value of "0", and a means for producing musical tones responsive to said product data words.

2. In combination with a musical instrument in which a plurality of data words corresponding to the amplitudes of points defining the waveform of a musical tone are computed from a preselected set of harmonic coefficients and are transferred sequentially to a means for conversion into musical waveshapes, apparatus for producing musical tones having a time variant spectra comprising;

a waveshape memory means, a means for computing responsive to said preselected harmonic coefficients whereby said plurality of data words corresponding to the amplitude of points defining the waveform of a musical tone are computed and stored in said first waveshape memory means, a memory addressing means for reading out data words stored in said waveshape memory means, a mask waveshape generator means wherein a time variant mask function is cyclically created having a number of data points in a cyclic period equal to the number of data points stored in said waveshape memory means, a phase offset means responsive to said memory addressing means whereby the initial phase of said time variant mask function is changed with time with respect to the initial phase of said data words read out from said waveshape memory means, a multiplying means whereby said data read out from said waveshape memory means are multiplied by said time variant mask function to form product data words, and a means for producing musical tones responsive to said product data words.

3. Apparatus according to claim 2 wherein said memory addressing means comprises;

a logic clock providing timing signals, and a cycle counter for counting said timing signals modulo the number of data points stored in said waveshape memory means wherein a reset signal is generated when the count state of said cycle counter returns to its minimal count state.

4. Apparatus according to claim 3 wherein said mask waveshape generator means comprises;

an offset counter incremented by each said reset signal and wherein said offset counter counts modulo a preselected modulo number, a comparator responsive to the count states of said cycle counter and said offset counter whereby an equal signal is generated when said count states are equal to each other, and a variable width pulse generator for generating a rectangular signal in response to said equal signal and wherein the width of said rectangular signal is selectively varied in response to a control signal.

5. Apparatus according to claim 4 wherein said multiplying means comprises;

a gate whereby data read out from said waveshape memory are transferred unaltered to said means for producing musical tones when said rectangular signal has a zero value and whereby data read out from said waveshape memory are not transferred to said means for producing musical tones when said rectangular signal has a non-zero value.

6. Apparatus according to claim 3 wherein said mask waveshape generator means comprises;

an offset counter incremented by each said reset signal and wherein said offset counter counts modulo a preselected modulo number, an adder for providing the sum of the count state of said cycle counter and said offset counter wherein said sum is modulo the number of data points stored in said waveshape memory means, a mask memory for storing a set of data points comprising a mask function, and a mask memory addressing means for reading out data points from said mask memory in response to the sum produced by said adder and whereby said read out data points are provided as a time variant mask function to said multiplying means.

7. In combination with a musical instrument having a waveshape generator for producing musical waveshapes, defined by a sequence of data words, apparatus for producing musical tones having a time variant spectra comprising;

a phase detection means responsive to said musical waveshape for creating a phase signal when said musical waveshape has a preselected phase, a mask generator means wherein a mask data word is generated in a binary digital format having a prespecified number of bits, a bit selection means whereby consecutive bits of said mask data word are selected in a cyclic and periodic order wherein the starting bit position is selected in response to said phase signal, a mask gate responsive to said selected bits from said mask data word whereby a data word in said sequence of data words defining said musical waveshape is transferred unaltered if the selected bit has a logic value of "1" and whereby a zero value data word is transferred if said selected bit has a logic value of "0", and a means for producing musical tones responsive to said product waveshape.

8. In combination with a musical instrument having a waveshape generator for producing musical waveshapes, apparatus for producing musical tones having a time variant spectra comprising;

a phase detection means responsive to said musical waveshape for creating a phase signal when said musical waveshape has a preselected phase, a mask waveshape generator means wherein a time variant mask function is generated having a period equal to the period of said musical waveshape, a phase offset means responsive to said phase signal whereby the initial phase of said time variant mask function is changed with respect to said preselected phase of said musical waveshape, a multiplying means whereby said musical waveshape is multiplied by said time variant mask function to produce a product waveshape, and a means for producing musical tones responsive to said product waveshape.

9. Apparatus according to claim 8 wherein said mask waveshape generator comprises;

an offset counter incremented by said phase signal and wherein said offset counter counts modulo a preselected modulo number, a logic clock providing timing signals, a delay counter for counting said timing signals, latch circuitry wherein a count signal is generated in response to said phase signal and wherein said count signal is not generated in response to a termination signal, a delay counter gating means whereby said timing signals are provided to said delay counter in response to said count signal, a comparator responsive to the count states of said delay counter and said offset counter whereby an equal signal is generated when said count states are equal to each other, and a variable width pulse generator for generating a rectangular signal in response to said equal signal, wherein said termination signal is generated, and wherein the width of said rectangular signal is selectively varied in response to a control signal.

10. Apparatus according to claim 9 wherein said multiplying means comprises;

a gate whereby said musical waveshape is transferred unaltered to said means for producing musical tones when said rectangular signal has a zero value and whereby said musical waveshape is not transferred to said means for producing musical tones when said rectangular signal has a non-zero value.

11. In a keyboard operated musical instrument having an array of keyswitches, apparatus for producing musical tones having a time variant spectra comprising;

a logic clock for providing timing signals, a frequency number memory for storing a set of frequency numbers, an assignor means whereby a frequency number is read from said frequency number memory in response to an actuated keyswitch in said array of keyswitches, a count down counter decremented by said read out frequency number in response to said timing signals and wherein said count down counter counts modulo a preset number and wherein a reset signal is generated when said count down counter is reset to its maximum count state, a waveshape generator means whereby a musical waveshape is generated in response to the count states of said count down counter, an offset counter incremented by said reset signal and wherein said offset counter counts modulo a preselected modulo number, an adder-accumulator for successively adding said read out frequency number to an accumulator and wherein said addition is modulo the maximum count state of said count down counter, an adder for providing the sum of the count state of said offset counter and the content of the accumulator in said adder-accumulator, a mask memory for storing a mask function, a mask memory addressing means for reading values of said mask function in response to the sum provided by said adder, a multiplying means whereby said musical waveshape is multiplied by the values read out of said mask memory to produce a product waveshape, and a means for producing musical tones responsive to said product waveshape.

* * * * *